US005555702A

United States Patent [19]

Sizer

[11] Patent Number: 5,555,702

[45] Date of Patent: Sep. 17, 1996

[54] PROCESS AND APPARATUS FOR PACKAGING LIQUID FOOD PRODUCTS

[75] Inventor: Charles E. Sizer, Hawthorn Woods, Ill.

[73] Assignee: Tetra Laval Holdings & Finance S.A., Pully, Switzerland

[21] Appl. No.: 468,751

[22] Filed: Jun. 6, 1995

Related U.S. Application Data

[62] Division of Ser. No. 58,261, May 10, 1993, Pat. No. 5,494, 691.

[51] Int. Cl.[6] ..... B65B 63/08

[52] U.S. Cl. ..... 53/127; 53/440; 53/467; 53/565; 99/470; 99/483; 426/399; 426/407; 426/521

[58] Field of Search ..... 53/127, 440, 467, 53/565; 99/470, 483; 426/399, 406, 407, 408, 521

[56] References Cited

U.S. PATENT DOCUMENTS

| | | | |
|---|---|---|---|
| 3,891,779 | 6/1975 | Robinson | 426/399 |
| 4,375,145 | 3/1983 | Mosse et al. . | |
| 4,384,438 | 5/1983 | Hilmerson . | |
| 4,419,301 | 12/1983 | Nahra et al. . | |
| 4,446,778 | 5/1984 | Cipelletti | 99/470 X |
| 4,464,156 | 8/1984 | Holmström . | |
| 4,539,903 | 9/1985 | Sugisawa et al. | 99/483 X |
| 4,560,564 | 12/1985 | Bruno, Jr. et al. . | |
| 4,584,932 | 4/1986 | Abma | 99/470 X |
| 4,850,270 | 7/1989 | Bronnert | 99/470 X |
| 5,209,157 | 5/1993 | Rodriguez | 99/470 X |
| 5,242,701 | 9/1993 | Poole . | |
| 5,360,055 | 11/1994 | Hup et al. | 99/470 X |

*Primary Examiner*—Lowell A. Larson
*Assistant Examiner*—Daniel Moon
*Attorney, Agent, or Firm*—Burns, Doane, Swecker & Mathis

[57] ABSTRACT

A liquid food product packaging process and apparatus is disclosed. The process may be employed for filling gable top cartons with high acid liquids such as orange juice. The product is heated to a sufficiently high temperature to sterilize the product for a short period of time and then cooled to an intermediate temperature that is sufficiently high to avoid the growth of bacteria, and at the intermediate temperature, the product is placed in unsealed gable top cartons. The cartons are sealed and allowed to cool to room temperature. This process produces a food package that has high seal integrity and relatively low carton distortion.

9 Claims, 2 Drawing Sheets

PROCESS AND APPARATUS FOR PACKAGING LIQUID FOOD PRODUCTS

This application is a divisional of application Ser. No. 08/058,261, filed May 10, 1993 U.S. Pat. No. 5,494,69.

FIELD OF THE INVENTION

This invention relates to processes and apparatus for packaging liquid food products such as fruit juices, in paperboard cartons, and more specifically, to packaging processes that provide a long shelf life for the liquid product without refrigeration.

BACKGROUND OF THE INVENTION

It has been common practice to package dairy products and fruit juices in gable top cartons which are constructed of a laminate having a paperboard substrate that is coated on both sides with a thermoplastic material, such as polyethylene. In order to prevent the migration of oxygen into the interior of the package, the laminate may include a barrier layer of aluminum foil or other suitable material between the substrate and the polyethylene liquid contact layer. The carton is formed from a carton blank into the proper shape and then the bottom seams are bonded together by heat sealing. During the filling operation, the juice or other liquid product is introduced into the carton through the open top. The carton is not completely filled, so that when the top is closed, there is a space above the liquid which is referred to as the headspace. The top of the carton is closed by folding opposite side walls at the center toward each other, while moving the other two side walls toward each other to form the top which resembles a roof gable. The top edges of all four sides overlap each other at the top of the gable and are heat sealed together under pressure. The headspace contains air or other gas that is trapped inside the carton when the gable top is closed and sealed.

Juice products, such orange juice, can be stored at room temperature in these cartons for substantial periods of time if microorganisms are excluded from the interior of the carton, or are killed by conventional techniques, such as heating, hydrogen peroxide treatment, or ultraviolet light treatment. Form, fill and seal processes and apparatus, such as the Tetra Brik system that is described, for example, in U.S. Pat. Nos. 4,384,438 and 4,464,156, have been used successfully for packaging juice and liquid food products in paper-coated cartons in which the liquid completely fills the package. This system, however, is not suitable for packaging liquid food products in gable top cartons.

Various processes have been proposed for filling gable top cartons with juice products under conditions which prolong the shelf life of the product, but these processes have the disadvantage of not producing a product having favorable taste, vitamin C retention, color or filling characteristics. There are two processes that have recently been proposed for packaging orange juice in gable top cartons that have a long shelf life at room temperature. The first of these processes is known as the post packaging thermal process (PPTP). The second process is known as the "hot fill" process.

The PPTP process, which is described in Canadian Patent No. 1,290,972, dated Oct. 22, 1991, involves filling a gable top carton with juice at room temperature. The carton is then sealed after it is filled. The filled and sealed carton, after being removed from the filling and sealing machine, is heated to a sufficiently high temperature and for a sufficiently long time to kill all of the bacteria in the carton. This heating step takes between 10 and 12 minutes. The filled cartons are then cooled to room temperature and may be stored without refrigeration for as long as three months.

In the Hot Fill process, unpasteurized juice is heated to about 95° C. The hot juice is then dispensed into the open top of a gable top carton. The filled cartons are sealed while the juice is maintained at 95° C. The cartons are then inverted to ensure that the headspace of the cartons is sterilized by the hot juice. The cartons are then cooled to room temperature over a period of about one-half an hour.

These processes have various disadvantages in the packaging of high acid liquid food products, particularly orange juice. The PPTP process requires filling and sealing the cartons at room temperature. The cartons are then heated to at least 75° C. for 10 to 12 minutes to sterilize the contents. When the sealed cartons are heated, both the product and the carton expand, which places a substantial stress on the packaging material, and may cause leakage. Further, the PPTP process takes about 35 minutes to complete the heating, holding and cooling steps.

When the cartons that have been filled according to the Hot Fill process or the PPTP process have cooled, there is a tendency for the product in the cartons to contract. This contraction creates a vacuum in the carton, which often causes the shape of the carton to be distorted. Another problem with the Hot Fill process is that orange juice has a substantially greater tendency to form foam when filling at elevated temperatures, so that it is difficult to precisely control the fill level in the carton and the foam interferes with the sealing of the top of the carton. Further, when the carton and the contents are heated to a temperature as high as 95° C., the strength of the seal at the top of the carton is substantially less than at lower temperatures. Another disadvantage of the use of these processes is that volatile flavor components are lost at a greater rate when the contents of the cartons are heated to a temperature of 95° C.

When packaging orange juice, it is advantageous to use a packaging laminate that includes a barrier layer which will prevent the loss of essential oils and flavor components in the juice. Typically, aluminum foil is used for this purpose. Recently, ethylene vinyl alcohol copolymers have been substituted for aluminum foil in these packaging laminates. In order to resist distortion of the package upon cooling, additional layers of polyethylene have been included in the laminate. This increases the cost of the laminate, which reduces the financial benefit of using paper-based packaging. Another problem that occurs upon cooling the packages that are produced by these processes is that a vacuum is created in the headspace which makes the carton difficult to open and which may be sufficient to cause the seal in the top fin to leak. Ambient air that leaks into the carton will cause premature spoilage of the orange juice.

OBJECTS AND SUMMARY OF THE INVENTION

It is an object of this invention to provide an improved process and apparatus for packaging high acid liquid food products, including orange juice and similar products.

It is another object of this invention to provide an improved process and apparatus for packaging high acid liquid food products, including orange juice and similar products in paperboard gable top cartons in a manner which preserves the vitamin C content of the juice, reduces the percentage of oxygen in the headspace, maintains good flavor qualities and avoids excessive loss of d-limonene and other ingredients.

These objects are accomplished in accordance with a preferred embodiment of the invention by a process in which the unpasteurized orange juice is heated to a temperature sufficiently high to kill the bacteria and other organisms that may cause spoilage. Heating to a temperature of 95° C. for 20 seconds should be adequate for this purpose. The juice is cooled to a temperature of about 70° C., and is then supplied to a conventional gable top carton filling machine. The juice is stored in a heated and insulated reservoir and is dispensed from the reservoir into the cartons. The cartons are then heat sealed. The product in the carton is maintained at about 65° C. to 70° C. while the carton is inverted in order to assure that all of the inside surfaces of the carton are wetted to sterilize the headspace at the top of the carton. The product is then cooled to room temperature over a period of about 40 minutes. Preferably, a heat exchanger in the juice conduit draws heat from the juice that is at 95° C. to reduce its temperature to about 70° C., while increasing the temperature of the juice that is being heated to pasteurization temperature.

DESCRIPTION OF THE DRAWINGS

A preferred embodiment of the invention is illustrated in the accompanying drawings in which.

DETAILED DESCRIPTION

Figure 1:
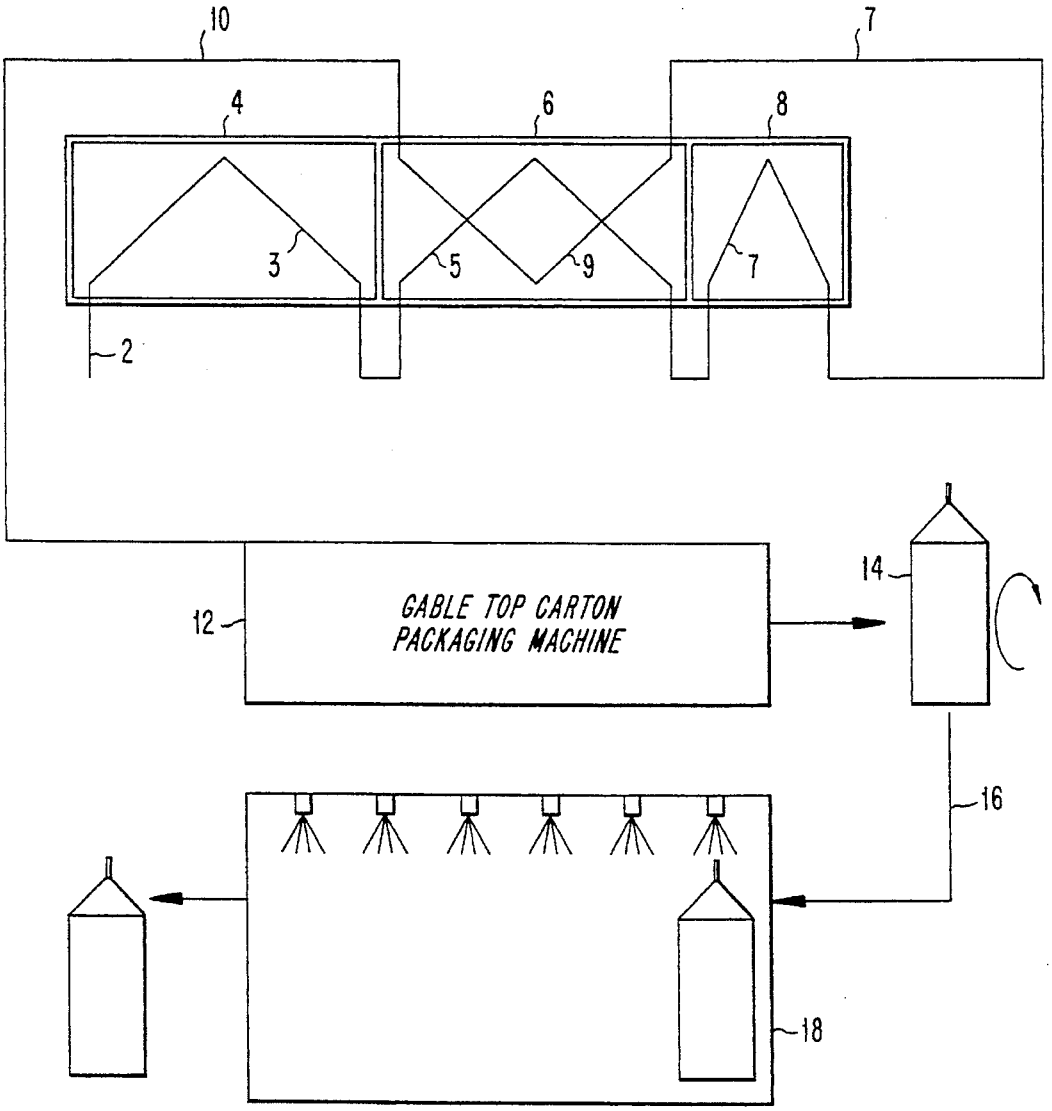
FIG. 1 is a schematic diagram of the process of this invention.

The apparatus of this invention, according to a preferred embodiment, is shown schematically in FIG. 1. A product pipe 2 supplies the product, such as unpasteurized orange juice which is to be packaged, to the apparatus of this invention. The pipe 2 is connected with a conduit 3 in a first heat exchanger section 4 which supplies heat to the product flowing through the conduit 3. The conduit 3 is connected at its outlet end with a conduit 5 which passes through a regenerative heat exchanger section 6. The conduit 5 is connected at its outlet end with a conduit 7 which passes through a final heat exchanger section 8. The length of the conduit in each of the heat exchangers 4, 6 and 8 and the flow rate is selected to provide the appropriate residence time for the product as it flows through the respective heat exchanger sections to cause the desired temperature change in the liquid food product. From the final heat exchanger section 8, the product conduit 7 conducts the liquid food product to the regenerative section 6 where the liquid product passes through a conduit 9 in which the product is cooled in heat exchange relationship with the liquid product in the pipe 5. A supply pipe 10 conducts the product from the regenerative heat exchanger section 6 to a carton filling and sealing apparatus, such as a gable top carton filling and sealing machine 12.

The model TR/7 gable top packaging machine available from Tetra Rex Packaging Systems is an example of a gable top filling machine that is suitable for the apparatus 12. The product is introduced into the machine 12 where a preformed gable top container is filled with the product through the open top, and the machine 12 automatically closes the top to form the gable shape and heat seals the top fin to produce a gable top carton 14. The carton 14 is not completely filled with the product, so that air and water vapor occupy the headspace between the surface of the liquid food product and the top fin seal.

The filled carton containing the liquid product at a temperature sufficient to prevent the growth of bacteria leaves the filling machine 12 and travels on a conveyor 16 which quickly inverts the carton, so that the hot liquid sterilizes the interior wall at the top of the carton. The upright filled carton then passes through a cooling chamber 18 where the carton is cooled, for example by a water spray, to approximately room temperature.

Figure 2:
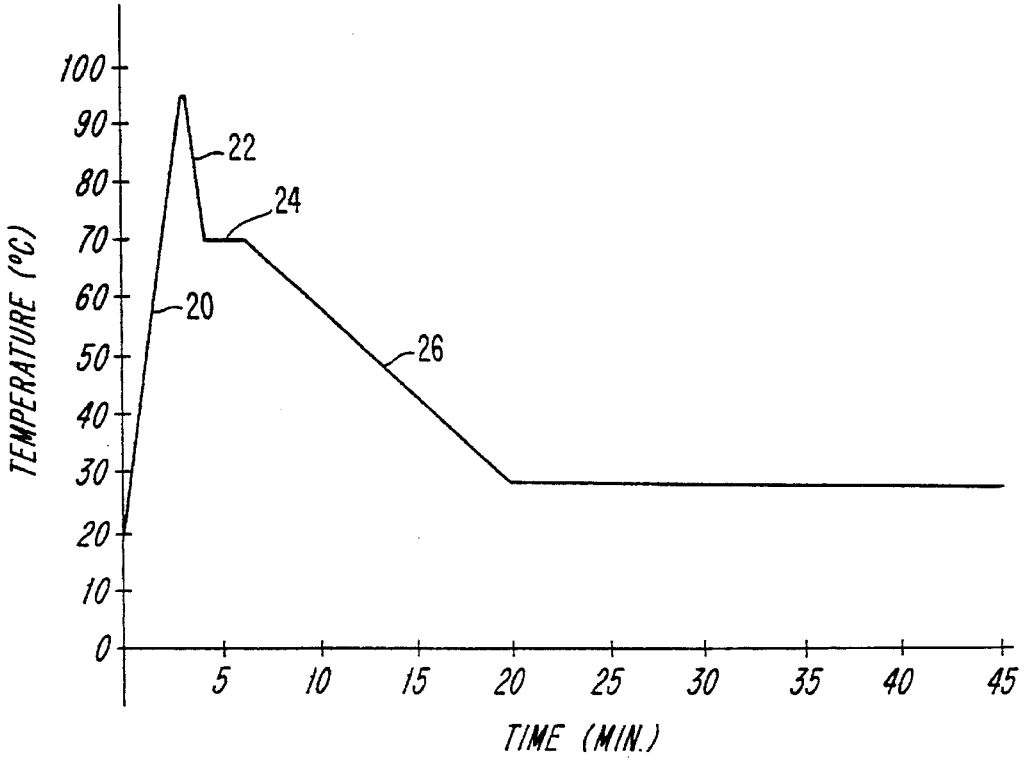
FIG. 2 is a graph of time vs. temperature of the process of this invention.

The process of this invention is suitable for any high acid liquid food product, such as orange, apple, grape, cranberry or other fruit juice having a value of less than 4.6 pH. FIG. 2 illustrates the temperature of the product versus time during the process. The product is heated to about 95° C. as represented by the line 20, and is then cooled rapidly (preferably less than 60 seconds) to about 70° C., as represented by the line 22. The product is maintained at about 70° C. while the carton is filled with the product, and the carton is sealed and inverted, line 24, which preferably occurs in less than five minutes. The filled carton then passes through the cooling chamber, represented by the line 26, until the product is cooled to approximately room temperature, 20°–30° C.

By heating the product to 95° C. for 20 seconds, mold bacteria and yeast in the product are killed. Since the interior walls of the cartons are not likely to have mold, maintaining the product at a temperature of 60°14 70° C. is adequate to keep the product sterile when filled in the carton.

Before entering the first heat exchanger section 4, the liquid product has a temperature of about 21° C. It is heated in the first heat exchanger section 4 to a temperature of about 50° C. In the regenerator section 6, the temperature of the liquid product in the conduit 5 is preferably heated to about 70° C. In the final heat exchanger section 8, the product in the conduit 7 is heated to about 95° C. The product is then supplied to the regenerative section 6 where the product in the conduit 9 is in heat exchange relation with the conduit 5. The length of the conduit 7 and the flow rate of the product are adjusted to keep the product at a temperature of about 95° C. for at least 20 seconds to assure that all organisms in the product are killed. In the regenerative section 6, the temperature of the product in the conduit 9 is reduced to about 70° C. In the filling machine 14, the liquid product is temporarily stored in a chamber that maintains the temperature at about 70° to 72° C. After the carton has been filled and sealed, it is inverted and cooled in the chamber 18 to a temperature of about 35° C. The filled carton is then turned right side up and upon leaving the conveyor 18, the cartons are allowed to cool to room temperature for storage.

For processing orange juice in accordance with the process of this invention, the specific gravity of the juice should be about 12.9° brix (percent soluble solids).

The cartons 16 may be made of a variety of materials, but typically the cartons are made of a laminate with a paper substrate having a coating on the outer and inner surface of a thermoplastic material such as low density polyethylene. In order to serve as a barrier to the transmission of oxygen into the carton and the loss of flavor components from the juice, the laminate may include a foil layer, an EVOH layer, or a layer of another suitable barrier material.

The filling machine may be any conventional machine which is capable of filling gable top cartons under aseptic conditions. For example, a Tetra Rex TR/7 filling machine manufactured by Tetra Rex Packaging Systems Inc. would be suitable for use in the process for the filling machine 12.

During the filling step, the temperature of the liquid product is maintained at between about 70° and 73° C. This temperature is maintained while the carton is inverted and until the cooling step starts.

As an illustration of the comparative advantages of the apparatus and process of this invention, the following examples are provided:

EXAMPLE I

Fifty packages were manually filled with unpasteurized orange juice and then sealed on a Tetra Pak TR/7 packaging machine using the PPTP process. The unsterilized cartons were filled at room temperature and heated to 75° C. in the carton over a period of 12 minutes. The filled cartons were held at this temperature for 10 minutes and then cooled to room temperature over a period of about 20 minutes. Of the 50 cartons that were produced, only 5 of the packages had sufficient package integrity to permit further testing. The remaining packages either leaked or the seals were disrupted. This condition was caused by the expansion of the liquid product and the carton during the heating process.

EXAMPLE II

In accordance with the Hot Fill process, the liquid juice product was pasteurized prior to filling the unsterilized cartons. The filling machine that was used was a Tetra Rex TR/7 filling machine that was adapted to maintain the temperature of the liquid product between 85° and 95° C. during the filling process in order to provide sterile conditions. After filling, the gable top carton was sealed by the machine and the cartons were then inverted in order to sterilize the headspace at the top of the carton. The filled cartons were then cooled to room temperature over a period of about 27 minutes. During the filling process, due to the high temperature of the liquid product, a portion of the product vaporizes, causing foam at the top of the carton. The presence of foam results in insufficient filling of the carton. The foam also interferes with the sealing of the fin at the top of the carton. Also due to the high temperatures during filling, volatile components of the juice are carried off by the steam that is vaporized from the hot liquid product.

EXAMPLE III

In accordance with the process of this invention, orange juice was heated to 95° C., held for 20 seconds and then cooled to 70° C. before being filled on the Tetra Rex TR/7 filling machine. Three hundred cartons were filled at a minimum temperature of 65° C. After the cartons were sealed, the cartons were inverted to sterilize the interior surfaces at the top of the carton with the hot liquid. The cartons were then cooled with a water spray during a period of 40 minutes from a temperature of 67° C. to 20° C.

By comparing the results of filling cartons with orange juice as described in Examples I, II and III, the advantages of the process of this invention are clearly demonstrated.

| | Fill Weight |
|---|---|
| Example I | 1039 g. (ave. grams/carton) |
| Example II | 801 g. (ave. grams/carton) |
| Example III | 1044 g. (ave. grams/carton) |

VITAMIN C RETENTION

The Vitamin C determination is described in the "Official Methods of Analysis of the Association of Official Analytical Chemists, 15th edition, 1990", Method 967.21 entitled "Vitamin C (Ascorbic Acid) in Vitamin Preparations and Juices".

| EXAMPLE | I | II | III | Raw Product |
|---|---|---|---|---|
| Day 1 | 41.4* | 39.9* | 40.4* | 44.5* |
| Day 6 | 41.7 | 41.0 | 43.1 | " |
| Day 13 | 37.5 | 32.9 | 37.8 | " |
| Day 20 | 35.3 | 34.2 | 39.9 | " |
| Day 41 | 40.3 | 29.7 | 40.9 | " |
| Day 76 | 29.4 | 14.5 | 33.7 | " |

*Vitamin C (mg/100 g)

HEADSPACE OXYGEN

The Mocon Oxygen Analyzer LC-700 F measured the oxygen concentration. The instrument was warmed up 20 minutes and calibrated using room air (20.6% oxygen). The syringe extracted a headspace gas sample and injected the gas into the instrument. This test measures the leakage of air into a sealed carton.

| EXAMPLE | I | II | III |
|---|---|---|---|
| Day 6 | Not tested deformed | 17.9* (extremely concave) | 13.2* (concave) |
| Day 13 | Not tested, deformed | 18.5 (extremely concave) | 10.6 (concave) |
| Day 20 | Not tested, deformed | 16.6 (extremely concave) | 8.0 (concave) |
| Day 36 | Not tested, deformed | 14.6 (extremely concave) | 4.0 (concave) |
| Day 42 | Not tested, deformed | 15.3 (extremely concave) | 3.1 (concave) |
| Day 78 | Not tested, deformed | 11.0 (extremely concave) | 0.6 (concave) |

*Percent Oxygen in Headspace

CARTON DISTORTION

Figure 3:
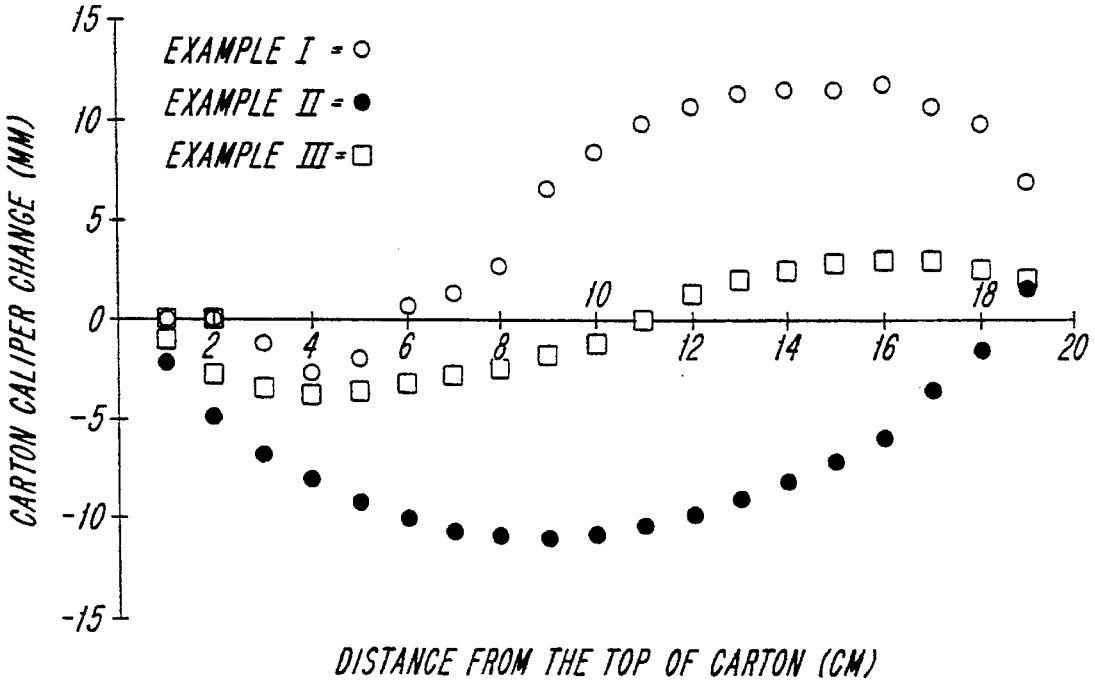
FIG. 3 is a graph showing the distortion of cartons of orange juice products packaged by the process of this invention as compared to other processes.

In order to measure the degree of distortion of the cartons produced by the processes of Examples I, II and III, cartons representative of these processes were measured by calipers between the opposite side panels and between the front and back panels. These measurements were taken at one centimeter intervals along the length of the panels. The measurements at each interval were averaged and are shown in FIG. 3.

The process of this invention also has an advantage over the PPTP process in retaining the good flavor qualities of the original product since there is less interaction due to the reduced temperature and decreased time of the process of this invention. The vitamin C retention is also better since the heating step in the process of this invention is less severe and the oxygen in the headspace is less. Another advantage of the process of this invention is that the tops of the cartons are heat sealed at a lower temperature (70° C.) than in the Hot Fill process (95° C.), thus producing a stronger bond between the polyethylene surface layers of the packaging laminate. Consequently, the cartons sealed in the process of this invention have less of a tendency to leak around the top seals. Further, as shown in FIG. 3, cartons filled in accordance with this process undergo substantially less distortion.

While this invention has been illustrated and described in accordance with a preferred embodiment of the invention, it is recognized that variations and changes may be made therein without departing from the invention as set forth in the claims.

What is claimed is:

1. Apparatus for packaging liquid food products in gable top cartons comprising:

(a) heating means for heating a liquid food product, said heating means including a plurality of successively arranged heat exchanger sections and a conduit extending through each of said heat exchanger sections to convey the liquid food product through said heat exchanger sections with the liquid food product being heated to a higher temperature in each successive heat exchanger section until the liquid food product reaches a first temperature sufficient to render the product commercially sterile;

(b) cooling means for cooling the liquid food product from said first temperature to a second temperature that is lower than said first temperature, but sufficiently high to maintain the liquid food product commercially sterile;

(c) packaging means for filling gable top cartons with the liquid food product from step (b) and subsequently sealing the cartons, the packaging means including a reservoir and temperature control means for maintaining the liquid food product in the reservoir at said second temperature.

2. The apparatus according to claim 1, wherein said heat exchanger sections include a regenerative heat exchanger section which forms said cooling means.

3. The apparatus according to claim 1 including conveyor means for inverting filled cartons, and means for cooling the cartons after inverting the cartons.

4. The apparatus according to claim 3, wherein said means for cooling includes a cooling chamber which directs a fluid spray at the cartons to cool the cartons.

5. Apparatus for packaging liquid food products in gable top cartons comprising:

a heating device for heating a liquid food product to a temperature sufficient to render the product commercially sterile, said heating device including a conduit for conveying liquid food product, a first heat exchanger section through which the conduit extends for raising the temperature of the liquid food product to a first temperature, a regenerative heat exchanger section through which the conduit extends for raising the temperature of the liquid food product from said first temperature to a second temperature, a second heat exchanger section through which the conduit extends for raising the temperature of the liquid food product from said second temperature to a third temperature which is sufficient to render the product commercially sterile, said conduit extending from said second heat exchanger section to said regenerative heat exchanger section to reduce the temperature of the liquid food product from said third temperature to a fourth temperature which is lower than said third temperature;

packaging means to which the conduit extends for filling gable top cartons with the liquid food product from the regenerative heat exchanger section and subsequently sealing the filled cartons;

a conveyor for conveying filled cartons; and cooling means through which the conveyor extends for cooling the filled cartons to a temperature less than said fourth temperature.

6. The apparatus according to claim 5, wherein said packaging means includes means for maintaining the temperature of the liquid food product at a temperature no greater than about 72° C. so that the cartons are filled with liquid food product at about 72° C.

7. The apparatus according to claim 5, wherein said cooling means includes a cooling chamber which directs a fluid spray at the cartons to cool the cartons.

8. The apparatus according to claim 5, including means positioned downstream of the packaging means to invert the filled cartons for purposes of sterilizing interior walls at a top of the cartons with the liquid food product.

9. The apparatus according to claim 5, wherein said packaging means includes a reservoir for holding the liquid food product and a temperature control device for maintaining the liquid food product at said fourth temperature.

* * * * *